US010555590B2

(12) United States Patent
Ohgi et al.

(10) Patent No.: US 10,555,590 B2
(45) Date of Patent: Feb. 11, 2020

(54) CARBON FORMED BODY, DRYER, AND NOZZLE

(71) Applicant: Ohgi Technological Creation Co., Ltd., Otsu-shi, Shiga (JP)

(72) Inventors: Takehiko Ohgi, Otsu (JP); Tatsuhiko Ohgi, Otsu (JP)

(73) Assignee: OHGI Technological Creation Co., Ltd. (JP)

( * ) Notice: Subject to any disclaimer, the term of this patent is extended or adjusted under 35 U.S.C. 154(b) by 132 days.

(21) Appl. No.: 15/635,271

(22) Filed: Jun. 28, 2017

(65) Prior Publication Data

US 2018/0014620 A1 Jan. 18, 2018

(30) Foreign Application Priority Data

Jul. 13, 2016 (JP) ..... 2016-138216
Apr. 7, 2017 (JP) ..... 2017-076445

(51) Int. Cl.
*A45D 20/12* (2006.01)

(52) U.S. Cl.
CPC ..... *A45D 20/122* (2013.01)

(58) Field of Classification Search
CPC ..... A45D 20/122
USPC ..... 34/90–100
See application file for complete search history.

(56) References Cited

U.S. PATENT DOCUMENTS 1,401,880 A * 12/1921 Connelly ..... B05B 7/04 239/405
2,263,370 A * 11/1941 Von Tavel ..... F02B 37/10 123/3
2,265,806 A * 12/1941 Livio ..... F04D 1/02 415/120
4,132,360 A * 1/1979 Lee, Jr. ..... A45D 20/124 239/383
5,626,156 A * 5/1997 Vicory, Sr. ..... A45D 2/10 132/229
6,222,988 B1 * 4/2001 Behrendt ..... A45D 20/12 219/541
8,893,400 B2 * 11/2014 Carme ..... A45D 20/42 132/115

(Continued)

FOREIGN PATENT DOCUMENTS

DE 102006056246 A1 * 5/2008 ..... A45D 20/08
EP 0395163 A1 * 10/1990 ..... A45D 20/16

(Continued)

OTHER PUBLICATIONS

Japanese Office Action dated Mar. 12, 2019.

*Primary Examiner* — Stephen M Gravini
(74) *Attorney, Agent, or Firm* — Miller Canfield

(57) ABSTRACT

A carbon formed body covers an outlet of a dryer. The carbon formed body is formed into a disc made from isotropic high-density graphite, and elongated holes are provided along a spiral line so as to penetrate through the disc. Hence, the opening areas of the carbon formed body can be extended while preventing reduction in the strength of the carbon formed body. Therefore, when the dryer that includes the carbon formed body attached to the outlet is in use, a smaller pressure loss is caused at the carbon formed body and the heat accumulation phenomenon is prevented. Furthermore, breakage of carbon formed bodies is inhibited at the time of manufacturing.

8 Claims, 9 Drawing Sheets

(56) References Cited

U.S. PATENT DOCUMENTS

| | | | | |
|---|---|---|---|---|
| 2007/0114219 | A1* | 5/2007 | Rizzuto, Jr. | A45D 20/12<br>219/222 |
| 2008/0262481 | A1* | 10/2008 | Cho | A45D 44/00<br>606/9 |
| 2011/0296705 | A1* | 12/2011 | Yoe | A45D 20/12<br>34/101 |
| 2013/0233336 | A1* | 9/2013 | Lazzaro | A45D 2/08<br>132/229 |
| 2017/0332763 | A1* | 11/2017 | DiRienzo | A45D 2/148 |
| 2018/0014620 | A1* | 1/2018 | Ohgi | A45D 20/122 |

FOREIGN PATENT DOCUMENTS

| | | | | | |
|---|---|---|---|---|---|
| JP | S53-112841 | U | | 9/1978 | |
| JP | S60-066708 | A | | 4/1985 | |
| JP | S60-153806 | A | | 8/1985 | |
| JP | 3011964 | U | | 3/1995 | |
| JP | 2004-351031 | A | | 12/2004 | |
| JP | 2014-233508 | A | | 12/2014 | |
| JP | 3199268 | U | | 7/2015 | |
| KR | 20110003175 | A | * | 1/2011 | A45D 20/10 |

* cited by examiner

CARBON FORMED BODY, DRYER, AND NOZZLE

CROSS-REFERENCE TO RELATED APPLICATION

This application claims the benefit of Japanese Patent Application No. 2017-76445, filed on Apr. 7, 2017, and Japanese Patent Application No. 2016-138216, filed on Jul. 13, 2016, of which the entirety of the disclosures is incorporated by reference herein.

FIELD

The present disclosure relates to a carbon formed body, a dryer, and a nozzle.

BACKGROUND

A hair dryer equipped with a carbon formed body attached to an outlet of the dryer is already proposed (in Registered Utility Model Publication No. 3011964, for example). In addition to the function to dry hair, such a hair dryer also has the function to facilitate blood circulation in a human body by utilizing far-infrared rays emitted from the carbon formed body when the dryer is in use. The carbon formed body attached to the outlet is bottomed cylindrical in shape, and through holes being circular in plan view are provided on the bottom wall so as to penetrate through the carbon formed body.

SUMMARY

By the way, when a hair dryer suffers a greater pressure loss of hot air at the outlet, the hair dryer is more prone to exhibit what is called the heat accumulation phenomenon in which heat is accumulated within the dryer body to cause an excessive increase in temperature of the dryer body. In particular, a greater flow rate of the hot air raises the likelihood of the heat accumulation phenomenon. The carbon formed body described in Patent Literature 1, however, has a limited possibility to extend opening areas from the viewpoint of preventing reduction in the strength of the carbon formed body, due to the circular shape in plan view of through holes. Loss of strength of the carbon formed body may cause, for example, frequent breakage of carbon formed bodies during assembly of hair dryers, resulting in lower yields.

A carbon formed body according to a first aspect of the present disclosure is a carbon formed body for use to cover an outlet of a dryer, comprising a plate-like member formed from graphite, and elongated holes extending along a spiral line and penetrating through the plate-like member.

A carbon formed body according to a second aspect of the present disclosure is a carbon formed body for use to cover an outlet of a dryer, comprising a plate-like member formed from graphite, and elongated holes extending along concentric circles and penetrating through the plate-like member, wherein each of the elongated holes is in communication with at least one of other adjacent elongated holes in a radial direction of the concentric circles.

BRIEF DESCRIPTION OF THE DRAWINGS

A more complete understanding of this application can be obtained when the following detailed description is considered in conjunction with the following drawings, in which.

DETAILED DESCRIPTION

An embodiment of the present disclosure will now be described with reference to the drawings. A dryer according to the present embodiment includes vent holes, with a carbon formed body attached to the dryer so as to cover an outlet of the dryer. The carbon formed body, when heated by hot air, emits far-infrared rays. Hence, the dryer has the function to facilitate blood circulation in a human body by using far-infrared rays emitted from the carbon formed body when the dryer is in use.

Figure 1:
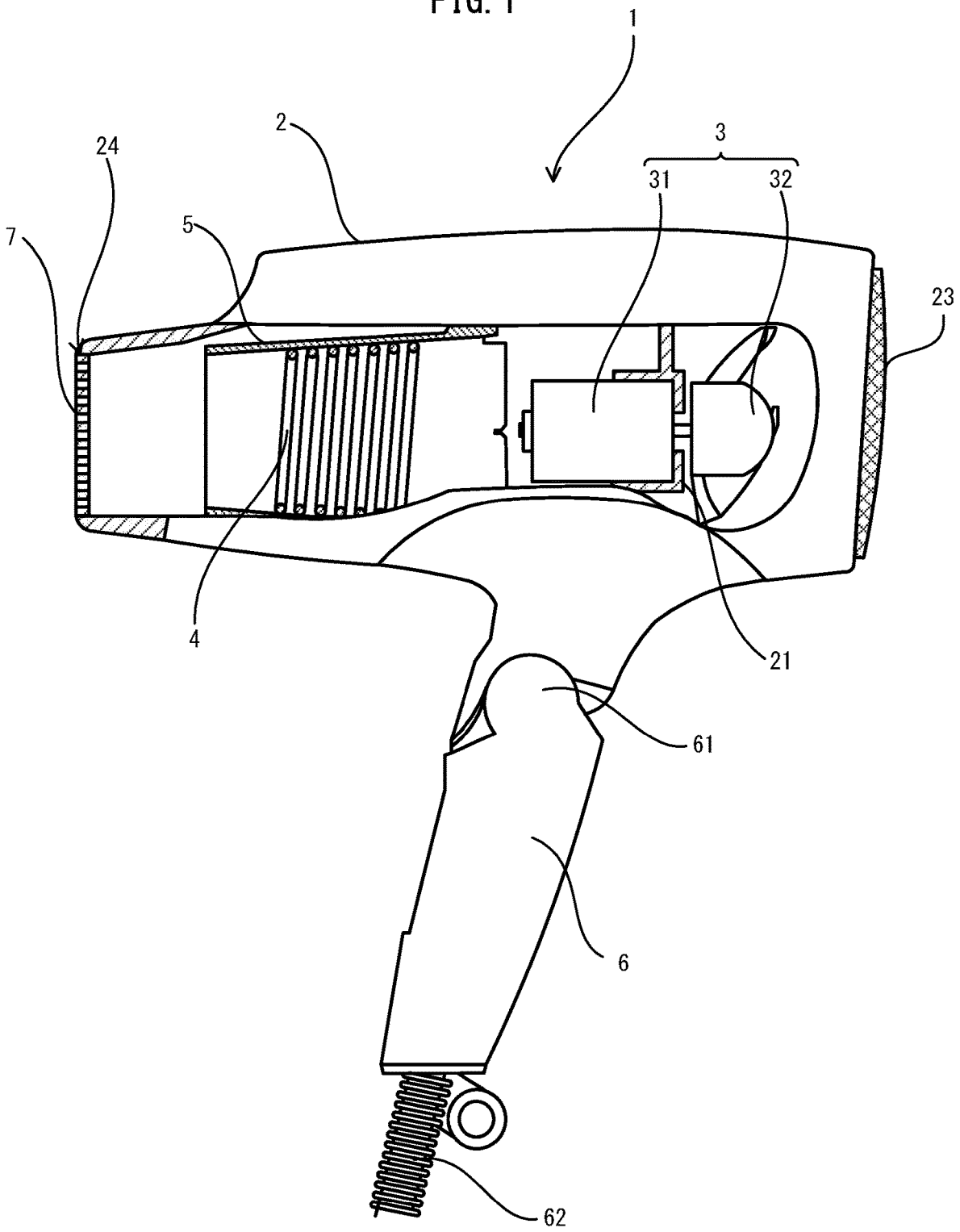
FIG. 1 is a partially broken side view of a dryer according to an embodiment of the present disclosure.

As illustrated in FIG. 1, the dryer 1 includes a housing 2, a handle 6, an air blower 3, a heater 4, a retaining frame 5, and a carbon formed body 7. The dryer 1 gives a substantially T-shaped appearance in the in-use state as illustrated in FIG. 1. The handle 6 is configured to be foldable at a joint 61, taking a posture of lying along the housing 2 when folded state (in the unused state). From the handle 6, a power cord 62 is led out for supplying power to a power supply (not illustrated) that supplies power to the air blower 3 and the heater 4.

The housing 2 is formed into a substantially elongated cylinder. On one end of a longitudinal direction of the housing 2, an inlet 23 is disposed for taking in outside air. On the other end of the housing 2, an outlet 24 is disposed for discharging inside air from the housing 2. The outlet 24 is in a circular shape when seen from a direction along the longitudinal direction of the housing 2.

The air blower 3 includes a motor 31 and a fan 32, which is driven by the motor 31 to rotate. The motor 31 drives the fan 32 to rotate, which creates an air flow in the housing 2 directed from the inlet 23 toward the outlet 24. The motor 31 is supported by a support 21, which is formed to be integrally continuous with the housing 2. Operation of the motor 31 is controlled by a switch (not illustrated), which is disposed on the handle 6.

The heater 4 includes a resistor element that is placed in a coiled state in the retaining frame 5, which is substantially cylindrical. The heater 4 can be turned on and off by means of a switch (not illustrated) disposed on part of the housing 2. Into the wiring connecting between the heater 4 and a power circuit, a temperature-controlled switch (not illustrated) that operates depending on the temperature inside the housing 2 is inserted. When the temperature inside the housing 2 reaches a predetermined temperature (100° C., for example), the temperature-controlled switch changes to the open state to deactivate the heater 4.

Figure 2A:
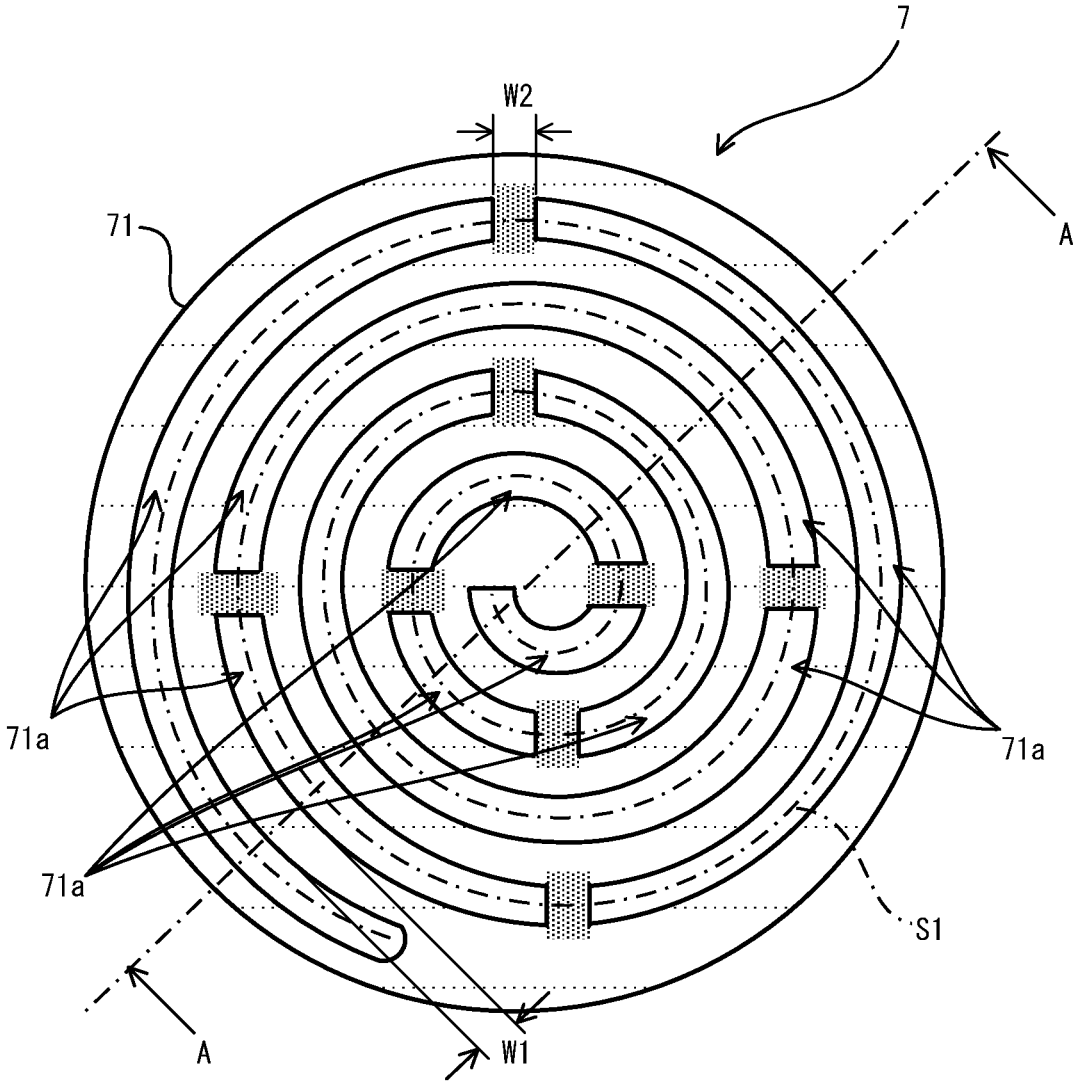
FIG. 2A is a plan view of a carbon formed body according to the embodiment.
Figure 2B:
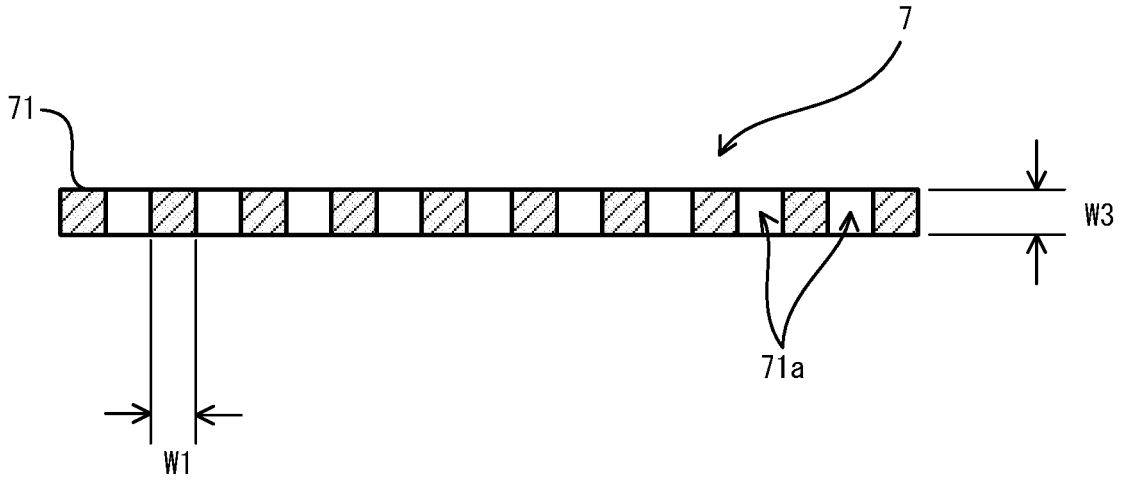
FIG. 2B is a cross-sectional view of the carbon formed body according to the embodiment, viewed along the line A-A indicated by arrows in FIG. 2A.

The carbon formed body 7 is attached to the housing 2 so as to cover the outlet 24 of the housing 2. As illustrated in FIGS. 2A and 2B, the carbon formed body 7 is formed into a plate in a circular shape in plan view, with arc-shaped elongated holes 71*a* provided along a spiral line S1 so as to penetrate through the carbon formed body 7. The carbon formed body 7 is formed by perforating a disc 71, which is made from isotropic high-density graphite, to form elongated holes 71*a*. The disc 71 is produced by, for example, using a method similar to the method for producing a "carbon formed body" described in Unexamined Japanese Patent Application Kokai Publication No. 2012-100777. Note that the disc 71 may also be formed by, for example, stacking graphite sheets made from expanded graphite. The carbon formed body 7 is not limited to a circular shape in plan view but may be formed in another shape matching the shape of the outlet 24 of the housing 2. For example, if the outlet 24 of the housing 2 is rectangular, the carbon formed body 7 may be in a rectangular shape in plan view.

The diameter of the carbon formed body 7 is set as appropriate according to the size of the outlet 24 of the housing 2, and may be set to 52 mm, for example. The width of an elongated hole 71*a* can be set to 3 mm to 4.5 mm. The thickness W3 of the carbon formed body 7 may be set to 0.5 mm to 3 mm. In such a case, from the viewpoint of the strength of the carbon formed body 7, both of W1, which is a distance between adjacent elongated holes 71*a* in a radial direction of the carbon formed body 7, and W2, which is a distance between adjacent elongated holes 71*a* in a circumferential direction, are preferably set to 1.5 mm to 2 mm.

Figure 3:
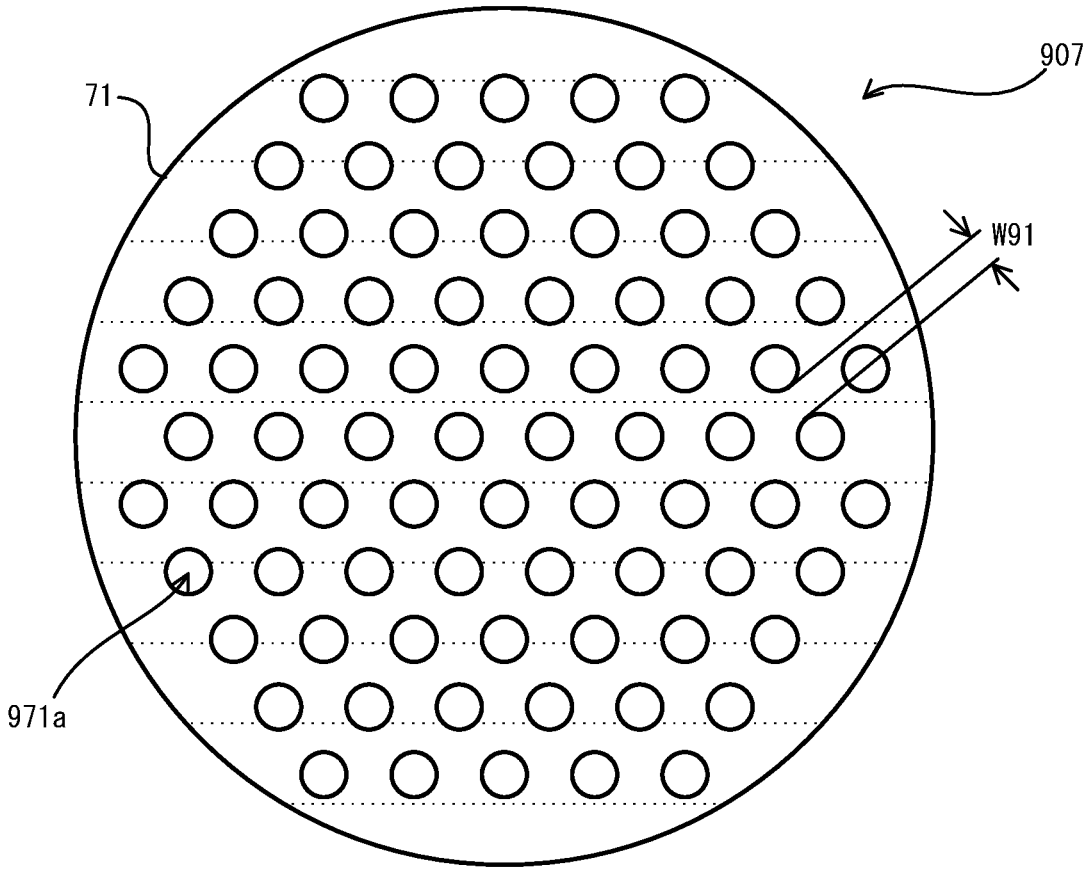
FIG. 3 is a plan view of a carbon formed body according to a comparative example.

The structure of the carbon formed body 7 according to the present embodiment will now be described while being compared with the structure of a carbon formed body according to a comparative example. As illustrated in FIG. 3, a carbon formed body 907 according to the comparative example is structured to include holes 971*a* having a circular shape in plan view provided so as to penetrate through a disc 71. Assume here that the carbon formed body 907 is 0.5 mm to 3 mm thick as with the carbon formed body 7. In such a case, from the viewpoint of the strength of the carbon formed body 907, W91, which is a distance between two adjacent holes 971*a* needs to be 1.5 mm or more. Thus, a sufficiently high ratio of the sum of opening areas of the holes 971*a* to the total area of the carbon formed body 907 is difficult to achieve.

On the other hand, the carbon formed body 7 includes elongated holes 71*a* disposed along the spiral line S1. Hence, a higher ratio of the sum of opening areas of the elongated holes 71*a* to the total area of the carbon formed body 7 than the ratio in the comparative example can be achieved even when the carbon formed body 7 has a thickness W3 of 0.5 mm to 3 mm. In other words, the carbon formed body 7 has larger opening areas in total of the elongated holes 71*a* compared with the carbon formed body 907 of the comparative example. Accordingly, a smaller pressure loss is caused at the carbon formed body 7 compared with the carbon formed body 907 of the comparative example.

As described above, the carbon formed body 7 according to the present embodiment is formed into a disc made from isotropic graphite, and elongated holes are provided along a spiral curve so as to penetrate through the disc. Hence, the opening areas of the carbon formed body 7 can be extended while preventing reduction in the strength of the carbon formed body 7. Therefore, when the dryer 1 that includes the carbon formed body 7 attached to the outlet 24 of the housing 2 is in use, a smaller pressure loss is caused at the carbon formed body 7 and the heat accumulation phenomenon is prevented. Furthermore, breakage of carbon formed bodies 7 is inhibited at the time of manufacturing.

In addition, the carbon formed body 7 according to the present embodiment is 0.5 mm to 3 mm in thickness W3, which is relatively thin. Hence, an additional advantage that the carbon formed body 7 can be made lighter at lower material costs.

(Variations)

Figure 4:
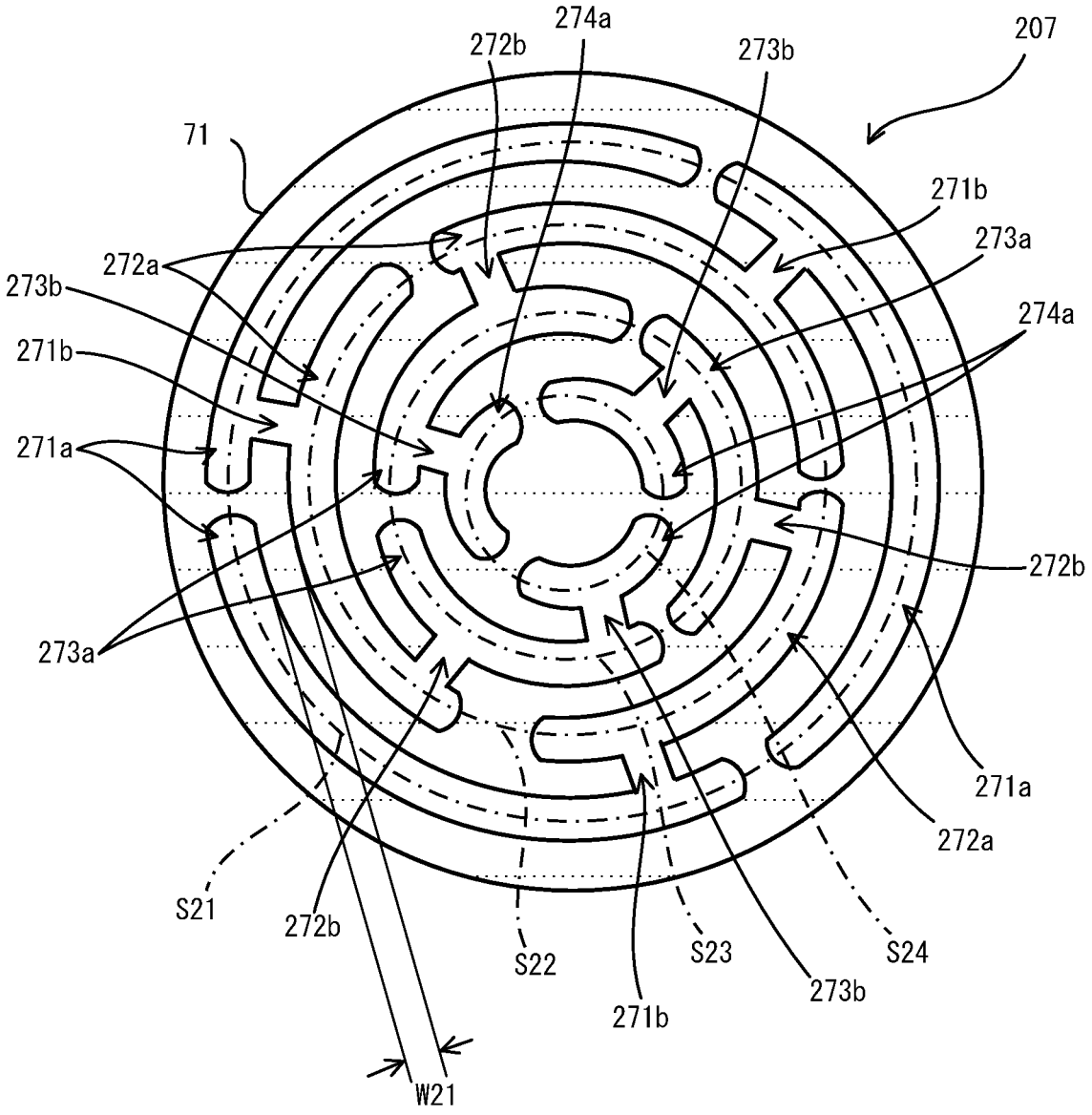
FIG. 4 is a plan view of a carbon formed body according to a variation.

An embodiment of the present disclosure has been described above, but the present disclosure is not limited to the configuration of the foregoing embodiment. For example, as illustrated in FIG. 4, a carbon formed body 207 may include elongated holes 271*a*, 272*a*, 273*a*, and 274*a* that are provided along (four in FIG. 3) concentric circles S21, S22, S23, and S24 so as to penetrate through the carbon formed body 207. The elongated hole 271*a* is in communication with an elongated hole 272*a*, which is another elongated hole adjacent to the elongated hole 271*a* in a radial direction of the concentric circle S21, via a connecting hole 271*b*. The elongated hole 272*a* is in communication with to the elongated holes 271*a* and 273*a*, which are other two elongated holes adjacent to the elongated hole 272*a* in a radial direction of the concentric circle S22, via connecting holes 271*b* and 272*b*. An elongated hole 273*a* is in communication with the elongated holes 272*a* and 274*a*, which are other two elongated holes adjacent to the elongated hole 273*a* in a radial direction of the concentric circle S23, via connecting holes 272*b* and 273*b*.

As with the forgoing embodiment, the diameter of the carbon formed body 207 is set as appropriate according to the size of the outlet 24 of the housing 2, and may be set to 52 mm, for example. The width of the elongated holes 271*a*, 272*a*, 273*a*, and 274*a* can be set to 3 mm to 4.5 mm. From the viewpoint of the strength of the carbon formed body 207, a distance W21 between any two adjacent elongated holes 271*a*, 272*a*, 273*a*, and 274*a* in a radial direction of the carbon formed body 207 is preferably set to 1.5 mm to 2 mm.

Such a configuration also has an operational effect similar to that of the carbon formed body 7 according to the embodiment.

The dryer may further include a nozzle (not illustrated) that is attached to the outlet 24 of the dryer 1 described in the embodiment, and the carbon formed body 7 or 207 may be located inside the nozzle. The nozzle is detachably attached to the housing of the dryer, and the carbon formed body 7 or 207 may be fixedly or detachably attached to the nozzle so as to obstruct an internal airflow path.

Figure 5:
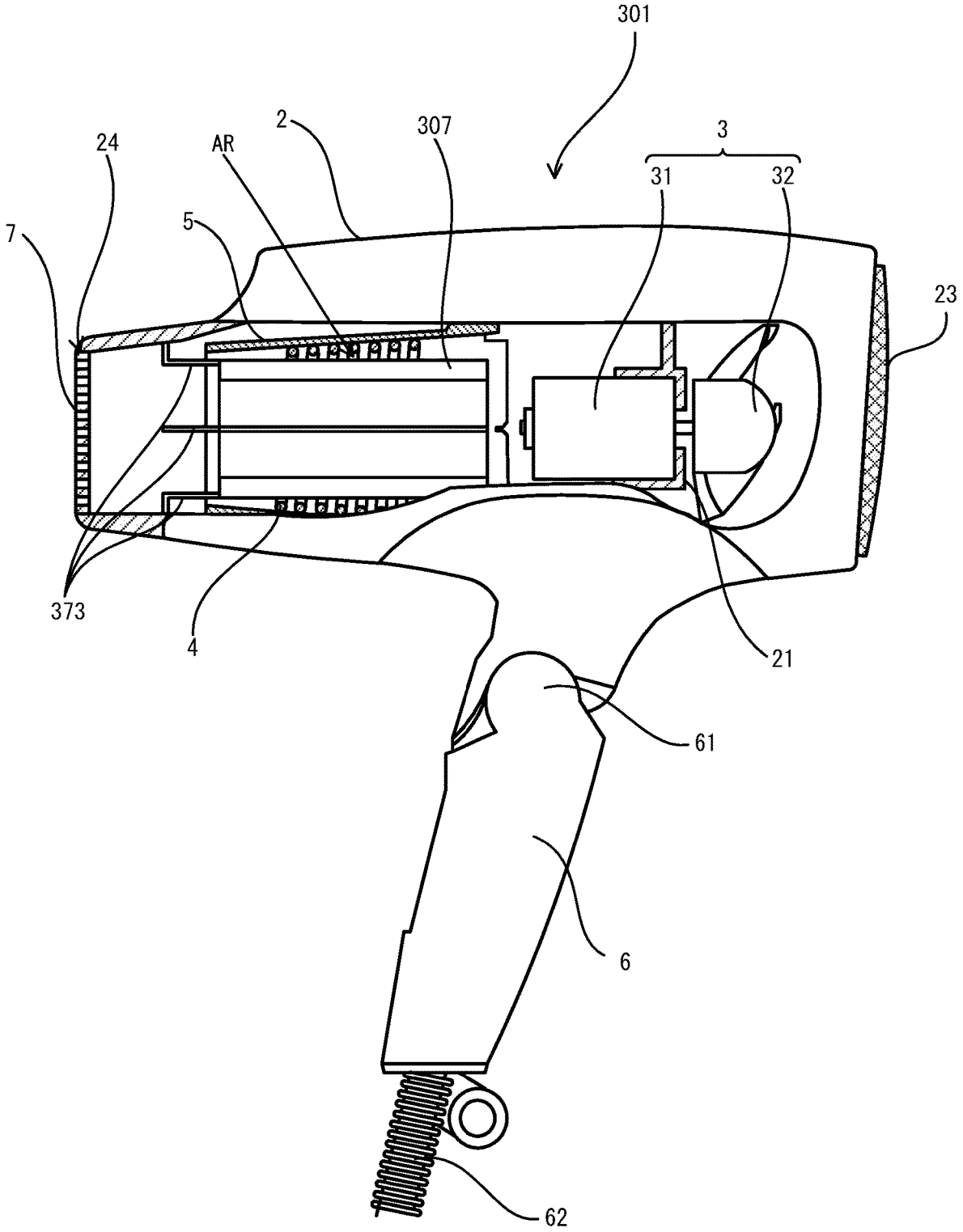
FIG. 5 is a partially broken side view of a dryer according to the variation.

The embodiment has been described with an example of the dryer 1 where the carbon formed body 7 is attached to the outlet 24 of the housing 2, but the carbon formed body 7 may be disposed at a place other than the outlet 24. For example, as illustrated in FIG. 5, a dryer 301 may include a carbon formed body (auxiliary carbon formed body) 307, which is disposed in a region AR to be heated by the heater 4 in the housing 2 of the dryer 301. Note that in FIG. 5, symbols identical to those in FIG. 1 are given to components similar to those in the embodiment. At least part of the region AR is included in an airflow path inside the housing 2.

Figure 6A:
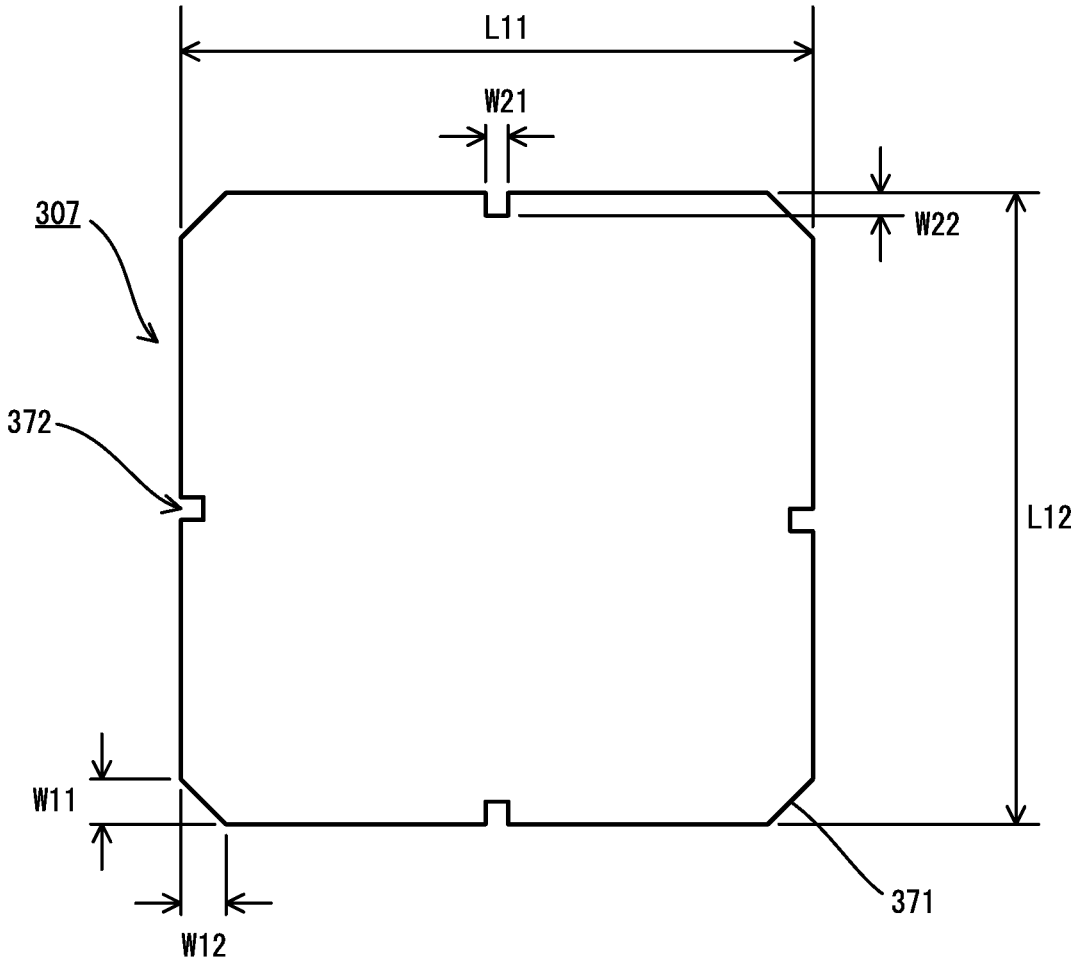
FIG. 6A is a plan view of the carbon formed body according to the variation.
Figure 6B:
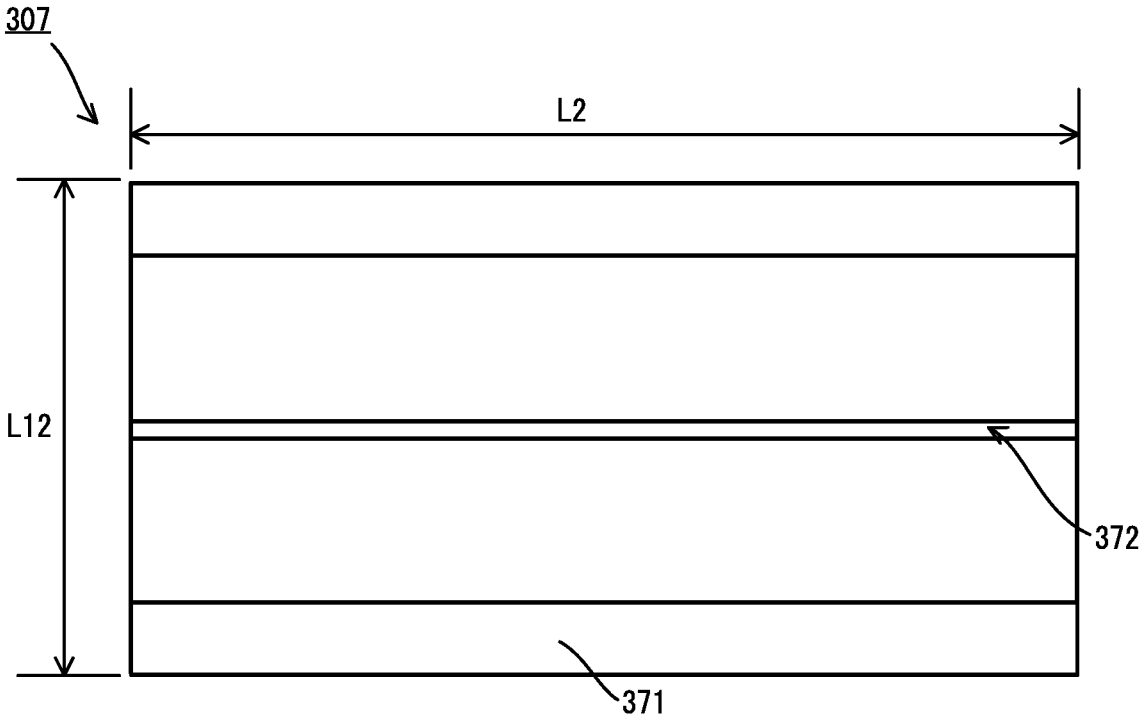
FIG. 6B is a side view of the carbon formed body according to the variation.

As illustrated in FIGS. 6A and 6B, the carbon formed body 307 is formed into, for example, a long block having a rectangular cross section perpendicular to the longitudinal direction, with sloping cuts made on the four corners. The carbon formed body 307 is formed from isotropic high-density graphite. The carbon formed body 307 includes four taper parts 371 formed along the longitudinal direction of the carbon formed body 307 and four grooves 372 to be used for securely holding the carbon formed body 307 inside the housing 2. The distance L11, L12 between opposing faces of the carbon formed body 307, and the length L2 are determined as appropriate according to the size of the housing 2. The lengths L11, L12, and L2 are set to, for example, 14.8 mm, 14.8 mm, and 55.5 mm, respectively. Each taper part 371 is formed so that W11 and W12, each of which represents the width along a side of the cross section perpendicular to the longitudinal direction, are approximately 2 mm each, for example. Each groove 372 is formed so that the width W21 and the depth W22 are approximately 1 mm each, for example. The carbon formed body 307 is disposed inside the housing 2, with support rods 373 disposed inside the housing 2 being inserted into the grooves 372, fastening the carbon formed body 307 to the housing 2 or the retaining frame 5. The support rods 373 are extended in such a way that, for example, the support rods 373 enter the retaining frame 5 from the outlet 24 side, of the housing 2, of the retaining frame 5 while the base ends of the support rods 373 are fastened to the inner wall of the housing 2.

Note that the carbon formed body may include, for example, at least one through-hole (not illustrated) provided to penetrate through the carbon formed body from one end to the other end along the longitudinal direction. The carbon formed body may also be substantially cylindrical. In such a case, the carbon formed body may include a groove formed on the lateral face of the carbon formed body, the groove extending in a spiral manner around the central axis of the carbon formed body. The carbon formed body is not limited to the aforementioned block in shape but may be, for example, in a plate or porous form.

The present configuration allows an airflow in the housing 2 to come into contact with not only the carbon formed body 7 but also the carbon formed body 307, thereby increasing the amount of far-infrared rays emitted from the dryer 301 when the dryer is in use. Therefore, the function to facilitate blood circulation in a human body through the use of infrared rays is enhanced.

The embodiment has been described with an example of the dryer 1 equipped with the heater 4. However, the dryer may be configured otherwise. For example, the dryer may include, in addition to the heater 4, a cooler 470 for cooling air in a housing 402 as with a dryer 401 illustrated in FIG. 7. Note that in FIG. 7, symbols identical to those in FIG. 5 are given to components similar to those in the variation described with reference to FIG. 5 above. The dryer 401 includes a heatsink 473 for dissipating out of the housing 402 the heat discharged from the cooler 470, and a thermal insulating member 474 for preventing heat from transferring from the heatsink 473 to the region AR in the housing 402.

A window 402*a* is formed on part of the housing 402 for exposing part of the heatsink 473. A sliding selector switch 461 is disposed on part of a handle 406 for switching between the state in which the heater 4 is operating and the state in which the cooler 470 is operating.

The cooler 470 includes a Peltier element 472 and a heat transferrer 471. The Peltier element 472 is a flat-shaped thermoelectric conversion element that uses the Peltier effect to create uneven heat at an electrified junction of two different types of metal or semiconductors. As the Peltier element 472, an element creating a temperature difference of, for example, approximately 30° C. between an electrified heat absorber 472*a* and heat rejector 472*b* may be employed. The heat transferrer 471 is formed into a bar from a metal such as copper or from graphite. One end of the heat transferrer 471 contacts one face of the carbon formed body 307, while the other end contacts the heat absorber 472*a* of the Peltier element 472. As a result, the heat absorber 472*a* of the Peltier element 472 is thermally coupled to the carbon formed body 307. The heatsink 473 is formed from a metal such as copper or from graphite, contacts the heat rejector 472*b* of the Peltier element 472, and is partially exposed to the outside. Note that the heatsink 473 may be formed of, for example, a layered body made by stacking graphite sheets that are made from expanded graphite.

In addition, the dryer 401 includes a heater driving circuit (not illustrated) that drives the heater 4 and a cooler driving circuit (not illustrated) that drives the cooler 470. The heater driving circuit drives the heater 4 with the power supplied from a power circuit (not illustrated), while the cooler driving circuit drives the cooler 470 with the power supplied from the power circuit. The selector switch 461 switches between the destinations of power supplied from the power circuit: the heater driving circuit and the cooler driving circuit, in response to a sliding operation performed by the user.

Note that the description given above is about an example of the dryer 401 in which the cooler 470 cools the carbon formed body 307. However, the example is merely an example, and, for example, the cooler 470 may be configured to cool the carbon formed body 7 or both of the carbon formed bodies 7 and 307.

The present configuration allows airflows in the housing 2 to be cooled, thereby giving cool feeling to users.

Embodiments and the aforementioned variations have been described with examples in which the carbon formed bodies 7, 207, and 307 are formed from isotropic high-density graphite, but materials are not limited to isotropic high-density graphite. For example, the carbon formed bodies may be formed from anisotropic graphite. Alternatively, the carbon formed bodies 7, 207, and 307 may be formed from carbon fiber reinforced carbon composite (C/C composite), which is obtained by sintering a mixture of carbon fibers and resin materials.

Figure 7:
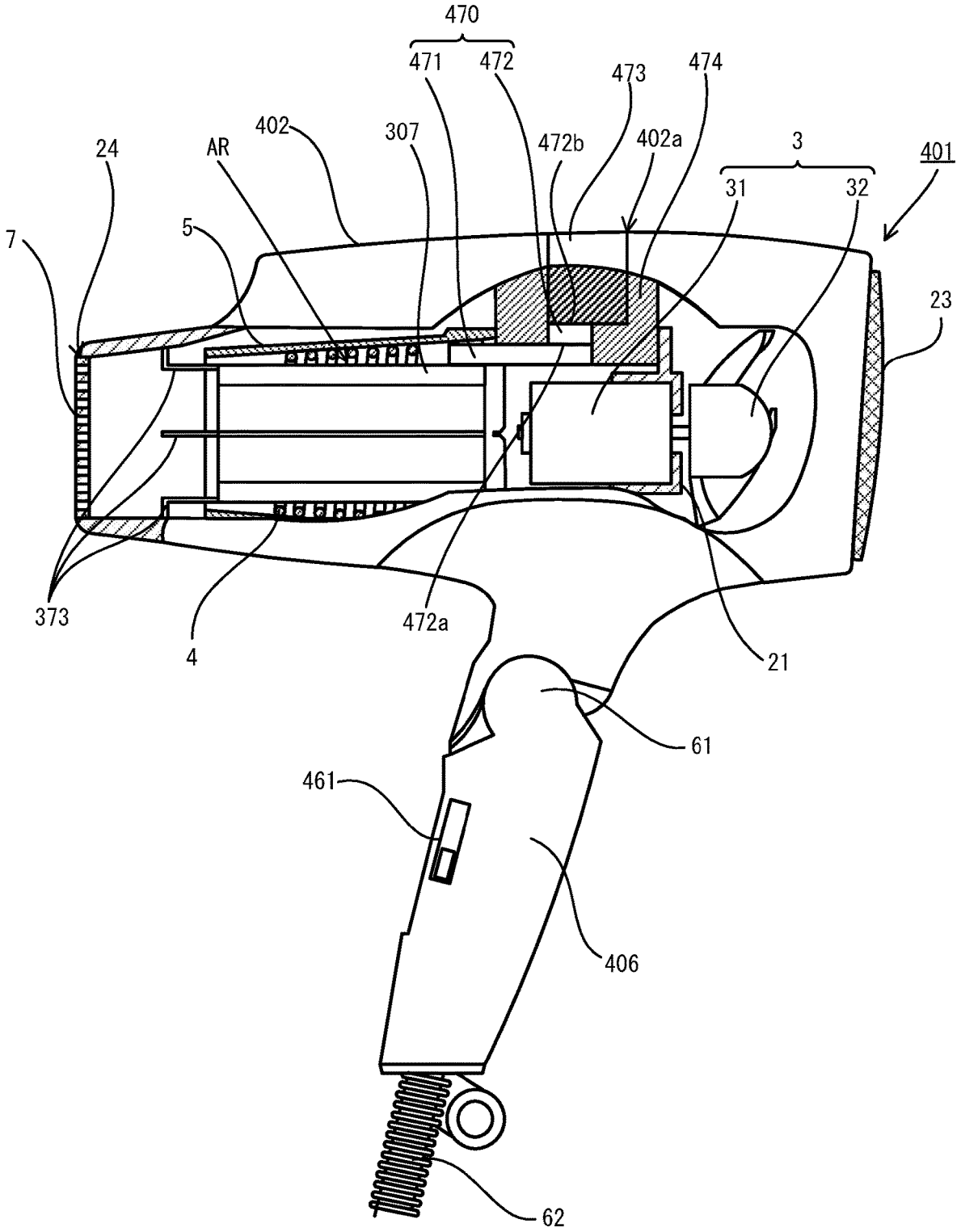
FIG. 7 is a partially broken side view of a dryer according to the variation.

The variation illustrated with FIG. 7 above has been described with an example in which the carbon formed body 307 is heated by the heater 4 which includes a resistor element. However, the heater may not necessarily include a resistor element but may include, for example, an induction coil to heat the carbon formed body 307 by induction. Alternatively, the heater may include a microwave generation source so that the carbon formed body 307 is heated under irradiation with microwaves.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A carbon formed body for use to cover an outlet of a dryer, the carbon formed body comprising:

a plate-like member formed from graphite; and elongated holes extending along a spiral line as viewed in a thickness direction of the carbon formed body and penetrating through the plate-like member in the thickness direction of the carbon formed body, wherein the thickness direction of the carbon formed body is parallel to a direction of a flow of air that flows in a housing of the dryer and that is discharged from the outlet.

2. A carbon formed body for use to cover an outlet of a dryer, the carbon formed body comprising:

a plate-like member formed from graphite; and elongated holes extending along concentric circles as viewed in a thickness direction of the carbon formed body and penetrating through the plate-like member in the thickness direction of the carbon formed body, wherein each of the elongated holes is in communication with at least one of other adjacent elongated holes in a radial direction of the concentric circles via connecting hole extending in the radial direction, wherein the thickness direction of the carbon formed body is parallel to a direction of a flow of air that flows in a housing of the dryer and that is discharged from the outlet.

3. A dryer comprising:

a housing including an inlet for receiving outside air and an outlet for discharging inside air outwards;

an air blower that forms in the housing an air stream flowing from the inlet to the outlet;

a heater that heats air flowing through the housing; and the carbon formed body according to claim 1.

4. The dryer according to claim 3, further comprising:

an auxiliary carbon formed body that is formed from graphite and is located in a region heated by the heater in the housing.

5. The dryer according to claim 4, further comprising: a cooler that cools the auxiliary carbon formed body.

6. A nozzle for detachable attachment to an outlet of a dryer, comprising the carbon formed body according to claim 1, wherein the carbon formed body is located inside the nozzle.

7. A dryer comprising:

a housing including an inlet for receiving outside air and an outlet for discharging inside air outwards;

an air blower that forms in the housing an air stream flowing from the inlet to the outlet;

a heater that heats air flowing through the housing; and the carbon formed body according to claim 2.

8. A nozzle for detachable attachment to an outlet of a dryer, comprising the carbon formed body according to claim 2, wherein the carbon formed body is located inside the nozzle.

* * * * *